United States Patent [19]

Heitmann et al.

[11] 3,948,084

[45] Apr. 6, 1976

[54] APPARATUS FOR TESTING CIGARETTES OR THE LIKE

[75] Inventors: Bob Heitmann; Werner Hinz, both of Hamburg, Germany

[73] Assignee: Hauni-Werke Körber & Co. KG, Hamburg, Germany

[22] Filed: May 6, 1974

[21] Appl. No.: 467,276

[30] Foreign Application Priority Data

May 12, 1973 Germany ..... 2324055

[52] U.S. Cl. ..... 73/41; 73/38; 73/45; 73/49.8

[51] Int. Cl.[2] ..... G01N 15/08; G01M 3/04

[58] Field of Search ..... 73/45.1, 45.2, 41, 38, 73/40.7, 45, 49.8

[56] References Cited

UNITED STATES PATENTS

| | | | |
|---|---|---|---|
| 3,527,347 | 9/1970 | Marradi | 73/81 |
| 3,543,927 | 12/1970 | Pinkham et al. | 73/45.1 |
| 3,769,832 | 11/1973 | Baier | 73/41 |
| 3,783,677 | 1/1974 | Heitman et al. | 73/41 |

*Primary Examiner*—Richard E. Aegerter
*Assistant Examiner*—Steven L. Stephan
*Attorney, Agent, or Firm*—Peter K. Kontler; John Kurucz

[57] ABSTRACT

A testing apparatus for cigarettes or the like has a rotary drum having axially parallel flutes for cigarettes, at least one ring-shaped carrier which is adjacent to one end and is driven at the speed of the drum about an axis which makes a small acute angle with the axis of the drum so that successive increments of the carrier approach the respective end of the drum during travel toward a testing station and move away from the drum during travel beyond the testing station. The carrier supports engaging elements in the form of pins or elastic sleeves which engage the adjacent ends of cigarettes during travel past the testing station. The pins can penetrate into relatively soft fillers of cigarettes and thereby cause a transducer to produce signals which are used for segregation of the respective cigarettes. The sleeves can engage the ends of wrappers of cigarettes during travel past the testing station to admit into the fillers a pressurized testing fluid or to draw a testing fluid through the fillers. The pressure of testing fluid is monitored by a transducer which produces signals for ejection of cigarettes having leaky wrappers because the pressure of fluid which passes through such defective wrappers deviates from a predetermined range of pressures which are indicative of satisfactory wrappers.

21 Claims, 8 Drawing Figures

77a
81
79
78
68
67
59
63
61
57
45
53
54
50
53a
47b
52
62
70
69
58
66
64
73
71
72
77
39
37
41
76
74
75
51
49
58A
III
42
40
36
44
W
43a
48A
47
46
48
43

APPARATUS FOR TESTING CIGARETTES OR THE LIKE

BACKGROUND OF THE INVENTION

The present invention relates to improvements in apparatus for testing rod-shaped articles which form part of or constitute smokers' products and wherein an open-ended tubular wrapper of cigarette paper, cork, reconstituted tobacco or the like surrounds a gas-permeable filler which consists of filter material and/or tobacco. More particularly, the invention relates to improvements in apparatus for the testing of rod-shaped articles in the form of plain or filter-tipped cigars, cigarettes, cigarillos or cheroots or sections of filter rods wherein the articles are moved sideways during transport toward, past and beyond one or more testing stations.

The wrappers of cigarettes or like rod-shaped articles (hereinafter referred to as cigarettes or filter cigarettes for short) are normally tested by a testing fluid which is admitted into or drawn from one or both ends of wrappers and whose pressure is monitored to detect such changes in pressure which are likely to develop when the wrapper has a hole, an open seam or another defect. A suitable transducer can be employed to produce signals which are indicative of cigarettes with defective wrappers, and such signals are utilized to effect segregation of corresponding cigarettes from satisfactory cigarettes. The rod-shaped articles to be tested may be of unit length (e.g., plain or filter cigarettes of unit length), of two times unit length (e.g., filter cigarettes of double unit length) or more than two times unit length (e.g., filter rod sections of four, six or eight times unit length). Presently utilized filter cigarette making machines normally produce filter cigarettes of double unit length and each such cigarette is thereupon severed midway between its ends to yield a pair of coaxial filter cigarettes of unit length. One filter cigarette of each pair is thereupon inverted end-for-end so that the filter plugs of all cigarettes face in the same direction. The cigarettes can be tested priot to and/or after severing. Testing subsequent to severing is preferred and more reliable because such mode of operation insures the detection of wrappers which become defective subsequent to or during severing. Moreover, filter cigarettes of unit length can be tested for the density of their filter tips and/or tobacco filler ends.

Many presently known testing apparatus employ a drum which is provided with axially parallel flutes for discrete cigarettes of unit length or multiple unit length and rotates with two coaxial carriers for sets of axially movable sealing tubes. The tubes move into sealing engagement with the adjacent ends of cigarettes prior to testing and are moved away upon completion of the testing operation so as to permit removal of tested articles and ejection of defective articles. Each tube normally comprises a follower which tracks the face of a stationary cam. Such means for moving the tubes are expensive and undergo extensive wear. Moreover, it is difficult to convert the just described testing apparatus for the testing of shorter or longer rod-shaped articles and/or for the testing of articles having larger or smaller diameters.

As stated before, the testing of cigarettes of unit length is normally preferred because such testing is more reliable since it insures the detection of defects which develop subsequent to severing of cigarettes of multiple unit length. Furthermore, if a cigarette of multiple unit length exhibits a defect in one of its sections (e.g., in one half of a filter cigarette of double unit length), the entire cigarette is discarded in spite of the fact that it could yield one or more satisfactory cigarettes plus one or more defective cigarettes. On the other hand, testing of cigarettes of unit length must be carried out at a high speed since a modern cigarette making machine can turn out up to and in excess of seventy articles per second. High-speed testing produces excessive wear on the moving parts of the testing apparatus so that there exists an urgent need for testing apparatus which are sufficiently reliable to allow for testing of extremely large numbers of articles per unit of time, especially for mass-testing of plain and filter cigarettes of unit length.

SUMMARY OF THE INVENTION

An object of the invention is to provide a novel and improved apparatus which can be used with equal advantage for testing of short or long rod-shaped articles, particularly cigarettes or the like wherein an open-ended tubular wrapper surrounds a homogeneous or composite gas-permeable filler, which can stand long periods of uninterrupted use, wherein the parts which are to be moved into and from engagement with the ends of articles to be tested are mounted and displaced in a novel and improved way, and which can be used as a superior substitute for presently known testing apparatus.

Another object of the invention is to provide a testing apparatus for rod-shaped smokers' products of unit length or multiple unit length which can subject each article to a single test or to a plurality of different tests, which enables the attendant or attendants to rapidly detect the cause of defects, and which can be designed to test the wrappers of articles with a pressurized testing fluid or with a fluid whose pressure is less than atmospheric pressure.

A further object of the invention is to provide the apparatus with novel means for moving sealing elements and/or other article-engaging devices into and from engagement with the wrappers and/or fillers of the articles to be tested.

The apparatus of the present invention can be used for testing of cigarettes or analogous rod-shaped articles wherein an open-ended tubular wrapper surrounds a gas-permeable filler, e.g., wherein a wrapper consisting of paper, cork or reconstituted tobacco surrounds a one-piece or composite rodlike filler consisting of tobacco and/or one or more types of filter material. The testing apparatus comprises means for conveying a succession of rod-shaped articles past a testing station and preferably including a drum which is rotatable about a first axis and has a plurality of receiving means (e.g., axially parallel peripheral flutes) for discrete rod-shaped articles, preferably annular or disk-shaped carrier means adjacent to one end of the conveying means, means for rotating the carrier means at the speed of the conveying means, and engaging elements (which may constitute pins or sealing elements) provided on the carrier means, one for each receiving means and each in register with the respective receiving means. The carrier means is rotatable about a second axis which is inclined with respect to the first axis (the two axes preferably make a relatively small acute angle) so that successive engaging elements approach and engage the adjacent ends of articles in registering receiving means during travel of engaging elements toward the testing station and that successive engaging elements move away from the adjacent ends of articles in registering receiving means during travel beyond the testing station. The engaging elements engage the adjacent ends of articles in registering receiving means during travel past the testing station so that the articles can be tested, e.g., for integrity of their wrappers, for density of their fillers or both.

The novel features which are considered as characteristic of the invention are set forth in particular in the appended claims. The improved testing apparatus itself, however, both as to its construction and its mode of operation, together with additional features and advantages thereof, will be best understood upon perusal of the following detailed description of certain specific embodiments with reference to the accompanying drawing.

DESCRIPTION OF THE PREFERRED EMBODIMENTS

Figure 1:
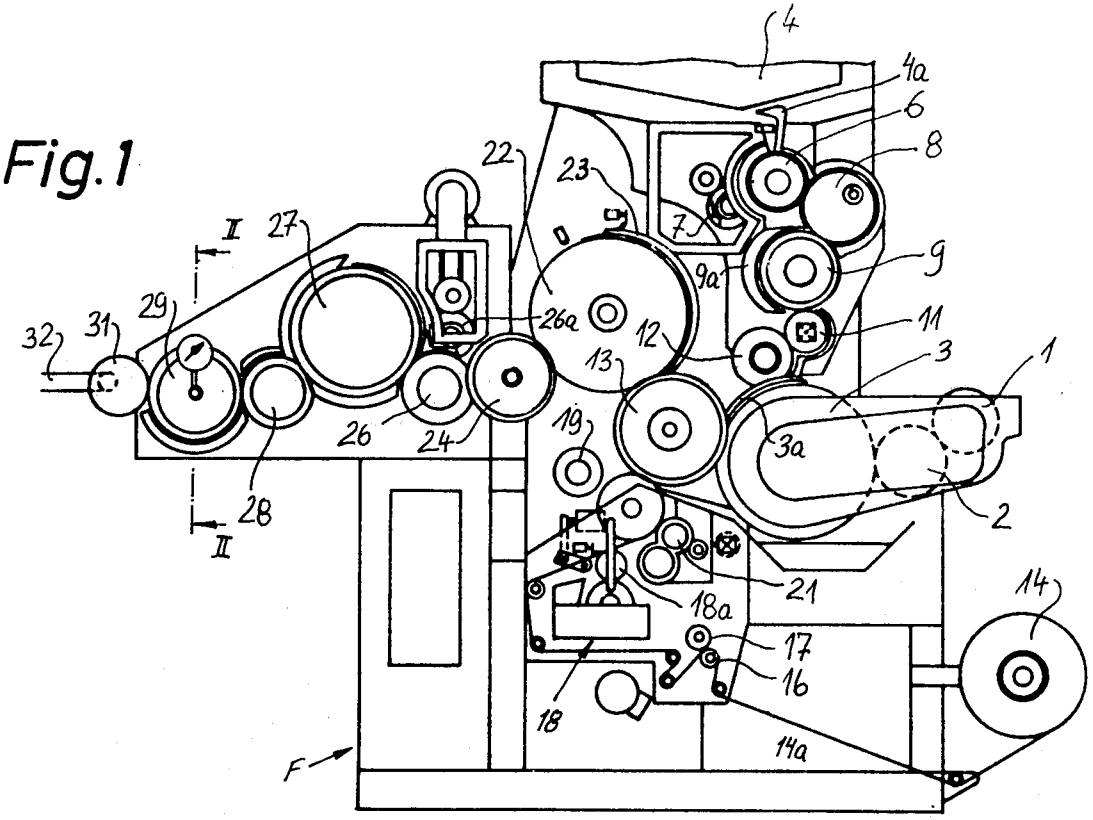
FIG. 1 is schematic elevational view of a filter cigarette making machine including a testing apparatus which embodies one form of the invention.

FIG. 1 shows a filter cigarette making machine of the type known as MAX, produced by Hauni-Werke of Hamburg-Bergedorf, Western Germany. The machine of FIG. 1 is directly coupled with a machine (not shown) which makes plain cigarettes and includes a drum-shaped transfer conveyor 1 serving to transport two rows of plain cigarettes of unit length sideways so that each of the two rows is transferred onto one of two drum-shaped aligning conveyors 2 (only one shown) forming part of the filter cigarette making machine. The plain cigarettes of one row on the transfer conveyor 1 of the cigarette making machine are staggered with respect to the plain cigarettes of the other row. The purpose of the conveyors 2 is to align each plain cigarette of one row with a plain cigarette of the other row and to transfer pairs of aligned plain cigarettes of unit length into successive flutes of a drum-shaped assembly conveyor 3 in the filter cigarette making machine. The cigarettes in the flutes of the assembly conveyor 3 are spaced apart so that they provide room for insertion of filter plugs or filter rod sections of double unit length.

The machine of FIG. 1 further comprises a magazine or hopper 4 having a chute 4*a* which discharges a single row of filter rod sections of six times unit length so that each filter rod section enters a discrete flute of a drum-shaped severing conveyor 6 cooperating with two rotary knives 7 (only one shown) to subdivide each filter rod section of six times unit length into three coaxial filter rod sections or filter plugs of double unit length. The discrete filter plugs of successive groups of three coaxial filter plugs each which are formed on the severing conveyor 6 are transferred onto three discrete staggering conveyors 8 which move the respective filter plugs along paths of different length and/or at different speeds so that each of the originally aligned or coaxial filter plugs of a group of three filter plugs leaving a flute of the severing conveyor 6 is staggered with respect to the other two plugs, as considered in the circumferential direction of the staggering conveyors 8. All three conveyors 8 deliver filter plugs into successive flutes of a drum-shaped shuffling conveyor 9 which cooperates with one or more stationary cams 9*a* to align the filtter plugs whereby the filter plugs form a single row wherein each preceding plug is in exact register with the nextfollowing plug. The shuffling conveyor 9 transfers successive filter plugs into successive flutes of a drum-shaped intermediate conveyor 11 which, in turn, transfers successive plugs into successive flutes of a drum-shaped accelerating conveyor 12 serving to insert a filter plug into the space between two coaxial plain cigarettes in each flute of the assembly conveyor 3. Thus, when a flute of the assembly conveyor 3 advances beyond the transfer station between the conveyors 3 and 12, it contains a group of three coaxial rod-shaped articles including two plain cigarettes of unit length and a filter plug of double unit length therebetween. Such groups then advance between two stationary cams 3*a* which move one or both plain cigarettes of each group axially toward the respective filter plug so as to eliminate the clearances between the filter plugs and the adjacent inner ends of aligned plain cigarettes before the groups are transferred onto a further drum-shaped conveyor 13.

The frame F of the filter cigarette making machine supports a bobbin 14 of convoluted cigarette paper or cork web 14a which is being withdrawn by two advancing rolls 16 and 17. The leader of the web 14*a* adheres to the periphery of a rotary suction drum 19 which is adjacent to the conveyor 13. Before an increment of the web 14*a* reaches the suction drum 19, one side thereof is coated with adhesive which is stored in the tank of a conventional paster 18 and is being applied to the web 14*a* by a roller-shaped applicator 18*a*. The drum 19 cooperates with a rotary knife 21 which severs the leader of the web 14*a* at regular intervals so as to convert the web into a succession of adhesive-coated uniting bands each of which is attached to a group of rod-shaped articles on the conveyor 13 in such a way that a portion of the adhesive-coated side of a uniting band adheres to the filter plug as well as to the adjacent inner end portions of the respective plain cigarettes of unit length.

The groups (each of which carries an adhesive-coated uniting band) are thereupon transferred onto a drum-shaped wrapping conveyor 22 which cooperates with a stationary or movable countersurface 23 to roll the uniting bands around the respective groups. Each uniting band is thereby converted into a tube surrounding the respective filter plug and the adjacent inner end portions of the aligned plain cigarettes of unit length. This completes the conversion of plain cigarettes and filter plugs into a row of filter cigarettes of double unit length. Such cigarettes are accepted by a further drum-shaped transfer conveyor 24 which delivers them into successive flutes of a drum-shaped severing conveyor 26 cooperating with a rotary knife 26*a* to sever each cigarette of double unit length midway across its filter plug so that each filter cigarette of double unit length yields two coaxial filter cigarettes of unit length. Each filter cigarette of unit length includes one of the plain cigarettes, one-half of the filter plug, and one-half of the respective tubular wrapper which is obtained by rolling a uniting band during passage through the gap between the conveyor 22 and the countersurface 23. The thus obtained pairs of coaxial filter cigarettes of unit length are thereupon transferred onto an inverting conveyor 27 which inverts one filter cigarette of each pair end-for-end so that the filter plugs of all filter cigarettes of unit length face in the same direction before they reach a further transfer conveyor 28. The inverted cigarettes of unit length are preferably placed into the spaces between neighboring non-inverted filter cigarettes of unit length. The conveyor 28 delivers successive filter cigarettes of unit length into successive receiving means or flutes 41 of a drum-shaped conveying member 40 (see FIG. 2) in a testing apparatus 29 which embodies the present invention. The apparatus 29 tests the fillers and/or wrappers of successive filter cigarettes of unit length and detects defective cigarettes which are thereupon segregated from satisfactory cigarettes. At least the satisfactory cigarettes are transferred onto a further conveyor 31 which delivers them onto the upper stretch of an endless belt conveyor 32 serving to transport satisfactory filter cigarettes to storage, to a tray filling apparatus or directly to a packing machine, not shown.

Figure 2:
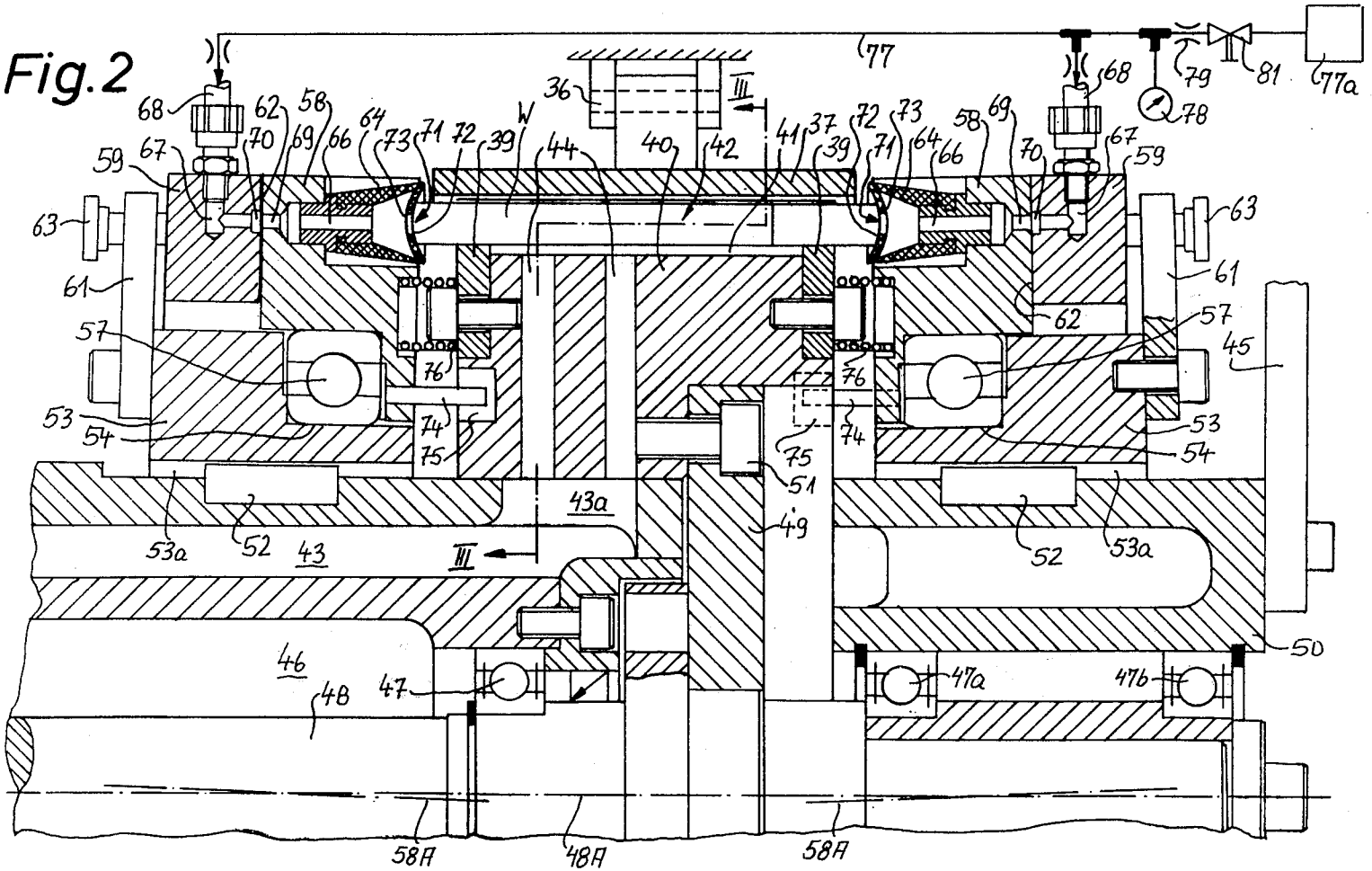
FIG. 2 is an enlarged fragmentary sectional view of the upper half of the testing apparatus substantially as seen in the direction of arrows from the line Ii—II of FIG. 1.
Figure 3:
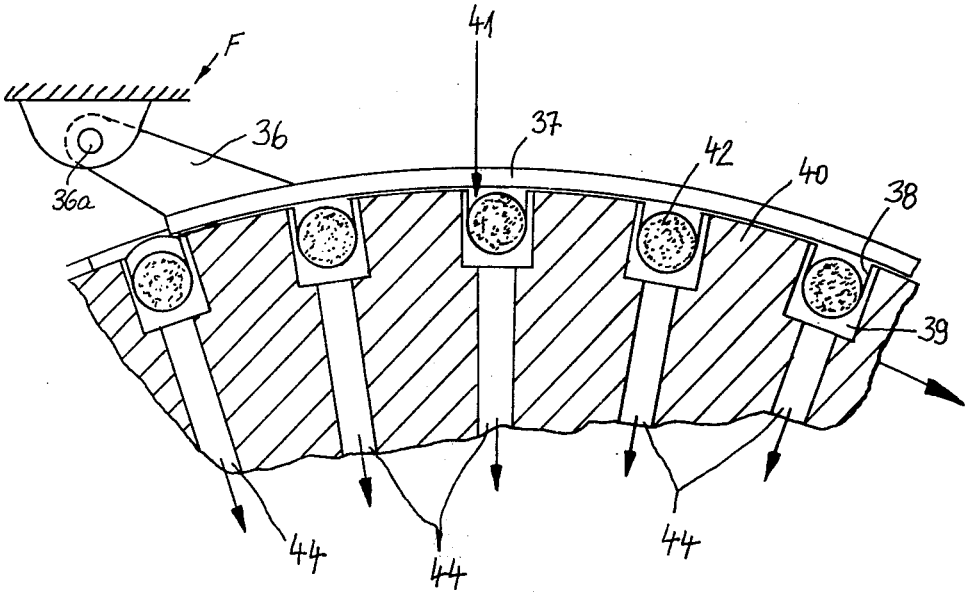
FIG. 3 is a fragmentary sectional view as seen in the direction of arrows from the line III—III of FIG. 2.

The details of the testing apparatus 29 are shown in FIGS. 2 and 3. This apparatus is designed to test the condition of wrappers W of successive filter cigarettes 42 of unit length. Each such cigarette comprises a filler which consists in part of tobacco shreds and in part of fibrous or other filter material, and an open-ended tubular wrapper W which includes the wrapper of the respective plain cigarette, the wrapper of the respective half of a filter plug and one-half of the tube which is obtained in response to rolling of the corresponding adhesive-coated uniting band during travel between the conveyor 22 and countersurface 23 of FIG. 1.

The conveying member 40 of the testing apparatus 29 is a rotary drum having in its periphery a series of axially parallel receiving means or flutes 41 for discrete filter cigarettes 42. A filter cigarette 42 which is transferred into a flute 41 at the transfer station between the conveyorr 28 of FIG. 1 and the drum 40 is attracted to this drum by suction. To this end, the drum 40 is formed with pairs of radially inwardly extending suction ports 44 the outer ends of which communicate with the respective flutes 41 and the inner ends of which communicates with an arcuate slot 43*a* in the periphery of a stationary hollow supporting shaft 46. The shaft 46 has an axially parallel channel 43 which is connected to a suction generating device, not shown, serving to draw air through those suction ports 44 which communicate with the arcuate slot 43*a*. The slot 43*a* extends from the transfer station between the conveyor 28 and drum 40 to the transfer station between the drum 40 and conveyor 31 of FIG. 1.

The means for rotating the drum 40 comprises a drive shaft 48 which is rotatable in antifriction bearings 47 installed in the interior of the hollow shaft 46. The drive shaft 48 is rigid with a ring-shaped torque transmitting element 49. The latter is coupled to the drum 40 by one or more screws or analogous fasteners 51. The hollow shaft 46 is located at one side of the torque transmitting element 49 and is coaxial with a stationary sleeve 50 which is located at the other side of the element 49. A portion of the drive shaft 48 extends into the sleeve 50 and is rotatable therein in antifriction bearings 47*a* and 47*b*. The sleeve 50 is secured to the frame F of the filter cigarette making machine by one or more levers, links or analogous coupling devices 45. The hollow shaft 46 is surrounded by a ring-shaped bearing member 53 which has an axially parallel internal groove 53*a* for a key 52 of the shaft 46 so that the bearing member 53 is movable axially toward and away from the respective end of the drum 40. A similar second fixed ring-shaped bearing member 53 is mounted on the sleeve 50 and is movable axially toward and away from the adjacent end of the drum 40. The second bearing member 53 has a groove 53*a* for a key 52 of the sleeve 50. The two bearing members 53 are provided with inclined endless surfaces 54 for the inner races of two antifriction ball bearings 57 the outer races of which support two ring-shaped carriers 58. The axes of the carriers 58 are shown at 58A, and it will be noted that the axes 58A are inclined relative to and make small acute angles with the axis 48A of the drive shaft 48. The carriers 58 are mirror symmetrical to each other with reference to the central symmetry plane of the drum 40, i.e., with respect to a plane which is normal to the axis 48A and extends midway between the axial ends of the drum 40.

The testing station of the apparatus 29 is located at the upper end of the drum 40, as viewed in FIG. 2. During travel toward this testing station, successive increments of the carriers 58 approach each other and thereupon move away from each other after having advanced beyond the testing station. This is due to the aforedescribed inclination of the axes 58A with respect to the axis 48A. The distance between the carriers 58 at the testing station is determined by two segment-shaped valve plates 59 which are adjustably secured to the respective bearing members 53 by links 61 and screws 63. Further adjustments can be achieved by moving the bearing members 53 with respect to the shaft 46 and sleeve 50, i.e., along the respective keys 52. The valve plates 59 have inner end faces 62 which abut and sealingly engage the adjacent outer end faces of the respective carriers 58. Adjustments of the bearing members 53 along the respective keys 52 are necessary when the apparatus 29 is to be converted from testing of relatively short cigarettes 42 to the testing of longer cigarettes or vice versa. The manner in which the bearing members 53 can be respectively secured to the shaft 46 and sleeve 50 in selected axial positions is not shown in the drawing. These bearing members constitute guides which can move the respective carriers 58 toward and away from the adjacent ends of the drum 40 and thereupon maintain the carriers at a selected distance from the drum.

Each carrier 58 supports a set of engaging elements, one for each flute 41 of the drum 40 and each in register with the respective flute. Each engaging element has an elastic sealing sleeve 64 which is mounted on a nozzle 66 anchored in the respective carrier 58 and having an axial passage for admission of testing fluid into the respective end 71 of the wrapper W in registering flute 41. The streams of testing fluid are admitted through nipples 68 which are secured to the valve plates 59 and discharge testing fluid into channels 67. Each channel 67 terminates in an elongated substantially bean-shaped arcuate groove 70 of the respective valve plate 59. The length of the grooves 70, as considered in the circumferential direction of the drum 40, determines the length of the testing station. The carriers 58 are provided with discrete connecting passages 69 which communicate with the adjacent grooves 70 during travel past the testing station and admit testing fluid into the axial passages of respective nozzles 66. The length of each groove 70 is preferably slightly less than the distance between the centers of two neighboring flutes 41 on the drum 40.

Each sealing sleeve 64 preferably consists of a relatively soft elastically deformable material and comprises a deformable end wall or membrane 72 which engages the adjacent end 71 of the respective wrapper W as well as the corresponding end face of the filler in such wrapper. Each membrane 72 is formed with a centrally located aperture 73 which admits a stream of testing fluid into the aligned filler. In the embodiment of FIGS. 2 and 3, the sealing sleeves 64 resemble frustoconical bodies which consist of soft rubber or soft elastomeric synthetic plastic material. The membranes 72 are readily deformable to conform to the ends 71 of the wrappers W and to the end faces of the respective fillers in spite of the fact that the axes of the nozzles 66 are not or need not be parallel to the axis 48A during travel of sealing elements 64, 66, 72 past the testing station. Were the sleeves 64 and/or their membranes 72 rigid, they would deform the cigarettes and would undergo excessive wear in response to repeated engagement with and disengagement from the cigarettes 42 in registering flutes 41. Each aperture 73 can be replaced by several smaller apertures. The combined cross-sectional area of apertures in each membrane 72 should be large enough to permit the entry of a satisfactory stream of testing fluid. The aperture or apertures 73 are preferably provided in the central portions of the respective membranes 72 so as to insure that each thereof is overlapped by the adjacent end face of the corresponding filler.

The means for coupling the carriers 58 to the drum 40, and hence to the torque transmitting element 49 of the drive shaft 48, comprises axially parallel pins 74 which extend into recesses or sockets 75 of the drum 40. The width of the sockets 75, as considered in the radial direction of the drum 40, exceeds the diameters of the coupling pins 74 to thus allow the carriers 58 to rotate about the respective axes 58A while sharing the angular movements of the drum 40. Helical springs 76 are interposed between the end faces of the drum 40 and the respective carriers 58 to bias the carriers against the end faces 62 of the adjacent valve plates 59. The springs 76 are stressed while they travel toward, past and beyond the testing station and are relieved while travelling about the lower half of the stationary shaft 46, as viewed in FIG. 2. As explained above, the mounting of carriers 58 for rotation about axes (58A) which are inclined with respect to the common axis 48A of the drive shaft 48 and drum 40 insures that the pairs of registering sealing sleeves 64 which travel toward the testing station approach each other to thereby move the respective membranes 72 into engagement with the adjacent ends 71 of the wrappers W, and that the pairs of registering sealing sleeves 64 thereupon move away from each other so as to permit for removal of tested filter cigarettes 42 at the transfer station between the drum 40 and conveyor 31 as well as for introduction of fresh filter cigarettes 42 at the transfer station between the conveyor 28 and drum 40.

The drum 40 carries two ring-shaped cradles 39 having registering cutouts or sockets 38 which receive portions of wrappers W in the respective flutes 41 so that the wrappers cannot contact the outer ends of the respective suction ports 44 in the drum 40. Thus, a cigarette 42 which is inserted into a flute 41 rests on the cradles 39 and the external surface of its wrapper W contacts only the relatively narrow surfaces bounding the innermost portions of the respective sockets 38. The cradles 39 are recessed into the respective end faces of the drum 40.

The testing station is overlapped by an arcuate cover or shroud 37 having two lugs 36 which are attached to the frame F by a pintle 36*a* (see FIG. 3). The shroud 37 overlies several flutes 41 and reduces the likelihood of penetration of foreign matter into the apertures 73 of the membranes 72. The foreign matter consists mainly of tobacco dust, especially if the testing apparatus 29 is located at a level below or close to another conveyor (see the inverting means 27 of FIG. 1) for tobacco-containing articles. In many tobacco processing plants, some tobacco dust is always present in the area where the tobacco processing machines are mounted, either independently of each other or in the form of production lines each of which consists of two or more directly or indirectly coupled machines.

The shroud 37 can be lifted to expose the parts at the testing station.

The pressure of air in those flutes 41 which are overlapped by the shroud 37 is less than atmospheric pressure because the shroud constitutes a means for sealing such overlapped flutes from the surrounding atmosphere while the flutes communicate with the suction channel 43 via slot 43*a* and the corresponding ports 44. Thus, a cigarette 42 which travels below the shroud 37 is surrounded by air whose pressure is less than atmospheric. When such cigarette travels between the grooves 70 at the testing station, its wrapper W receives compressed testing fluid via the respective apertures 73 so that the pressure differential between the interior and exterior of its wrapper W increases. Since the cradles 39 maintain the wrappers W out of contact with the drum 40, the entire external surface of a wrapper W at the testing station (with the exception of two small portions in the respective sockets 38) is maintained below atmospheric pressure.

The means for passing a compressed testing fluid (e.g., air) into the grooves 70 comprises a supply conduit 77 which is connected with the nipples 68 and contain a preferably adjustable flow restrictor 79 followed by a pressure gauge 78. The flow restrictor 79 is installed upstream of an adjustable pressure regulating valve 81. The valve 81 also serves as a shutoff valve to seal the nipples 68 from a source 77*a* of compressed testing fluid when the apparatus 29 is not in use.

The gauge 78 may constitute a transducer which produces signals indicating the fluid pressure in the wrappers W of cigarettes 42 at the testing station. When a wrapper W exhibits a leak, the pressure of fluid in the conduit 77 drops and the gauge 78 furnishes a signal which is used to segregate the respective (defective) cigarette 42 from satisfactory cigarettes, either on the drum 40 or on a conveyor which follows the testing apparatus 29.

Reference may be had to the commonly owned copending application Ser. No. 455,814 filed Mar. 28, 1974 by Uwe Heitmann et al. This copending application describes in detail several modes of testing cigarettes or the like, either with compressed testing fluid or with testing fluid whose pressure is less than atmospheric.

The operation of the testing apparatus 29 is as follows:

The drive shaft 48 receives motion from the main prime mover of the filter cigarette making machine and causes the torque transmitting element 49 to rotate the drum 40 at the speed of the shaft 48 whereby the drum rotates the carriers 58 through the medium of the coupling pins 74. The channel 43 of the hollow shaft 46 is connected to the inlet of a fan or another suitable suction generating device which draws air from the slot 43*a* and from those suction ports 44 which communicate with the slot 43*a* during travel from the transfer station between the conveyor 28 and drum 40 toward the transfer station between the drum 40 and conveyor 31. Consequently, each filter cigarette 42 which enters a flute 41 at the transfer station between the conveyor 28 and drum 40 is attracted to the cradles 39 by suction in the respective ports 44 and remains in the respective flute 41 (without actually touching the drum) until it reaches the transfer station between the drum 40 and conveyor 31. The flow of air from the open outer sides of the flutes 41 toward the innermost portions of such flutes and the respective ports 44 is throttled by the cigarettes 42 in the corresponding sockets 38, i.e., there develops a pressure differential between the outer and inner sides of wrappers W in the flutes 41 and such differential suffices to insure the retention of cigarettes in the cradles 39. As shown in FIG. 3, the width of a flute 41, as considered in the circumferential direction of the drum 40, only slightly exceeds the diameter of a wrapper W. Two registering sealing sleeves 64 which reach the transfer station between the conveyor 28 and drum 40 allow for introduction of a cigarette 42 without any interference on the part of the respective memberanes 72 due to the aforementioned mounting of carriers 48 for rotation about the axes 58A. As a filter cigarette 42 advances toward the testing station at the upper end of the drum 40 shown in FIG. 2, the corresponding sealing sleeves 64 are caused to move toward each other so that their membranes 72 engage the respective ends 71 of the wrapper W and the respective end faces of the filler in such wrapper. The inclination of the endless paths along which the sealing sleeves 64 travel toward, past and beyond the testing station is selected with a view to insure a satisfactory sealing engagement between the wrappers W and fillers on the one hand and the respective membranes 72 on the other hand without, however, deforming and/or otherwise damaging the sensitive articles 42. Due to such sealing engagement between the membranes 72 and the respective ends of articles 42 which approach the testing station, the streams of testing fluid which are admitted by the nozzles 66 as soon as the nozzles reach the grooves 70 of the respective valve plates 59 enter the wrappers W practically without any losses in testing fluid. Consequently, by monitoring the pressure of testing fluid (see the gauge 78) at the time such fluid is free to enter a wrapper W at the testing station, the apparatus 29 can determine whether or not the pressure and/or another characteristic of the respective stream is indicative of a satisfactory cigarette or a defective cigarette. The defective cigarettes are thereupon segregated from satisfactory cigarettes, either during travel from the testing station toward the transfer station between the drum 40 and conveyor 31, on the conveyor 31, or on the conveyor belt 32. As a rule, the monitoring of streams of testing fluid is accompanied by generation of electric or other signals, and such signals are utilized to bring about a segregation of defective cigarettes from satisfactory cigarettes. The carriers 58 cause the aligned sealing sleeves 64 to move apart during travel from the testing station so that the articles (namely, at least the satisfactory cigarettes 42) can be transferred onto the conveyor 31. The suction ports 44 are sealed from the slot 43*a* not later than when the respective flute 41 reaches the transfer station between the drum 40 and conveyor 31 so that the satisfactory cigarettes can be readily removed from their sockets 38.

Figure 4:
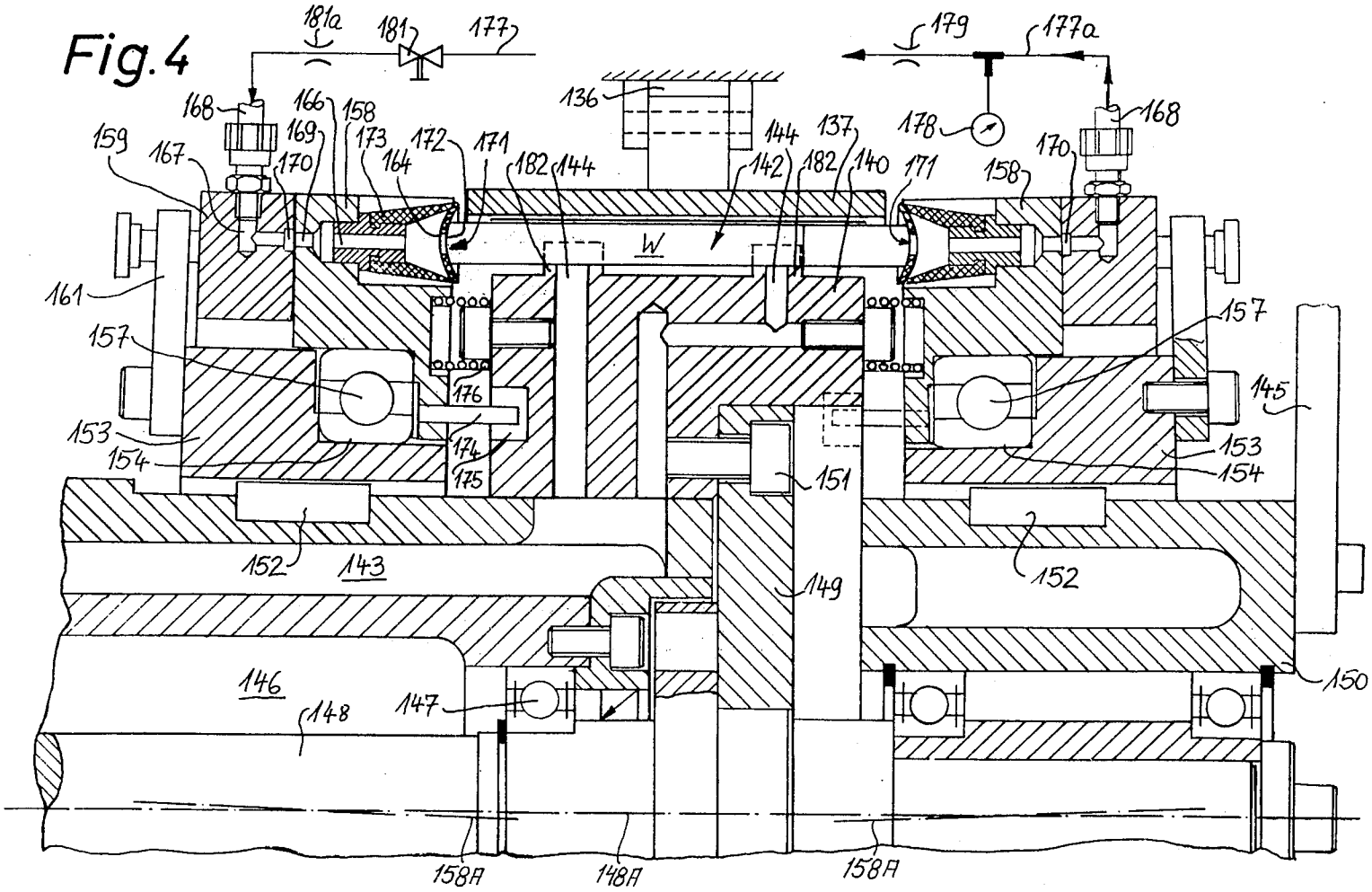
FIG. 4 is a sectional view similar to that of FIG. 2 but showing a portion of a second testing apparatus.

The testing apparatus of FIG. 4 constitutes a first modification of the apparatus which is shown in FIGS. 2–3. All such parts of this modified testing apparatus which are identical with or clearly analogous to the corresponding parts of the first apparatus are denoted by similar reference characters plus 100. The main difference is that the gaseous testing fluid is caused to enter into one end 171 and to leave through the other end 171 of a wrapper W forming part of a cigarette 142 at the testing station between the grooves 170. The left-hand nipple 168 of FIG. 4 receives testing fluid from a supply conduit 177 which contains an adjustable regulating valve 181 installed therein upstream of a flow restrictor 181*a*. The other nipple 168 discharges testing fluid into a second conduit 177*a* which contains a flow restrictor 179 and is connected with a pressure gauge 178 preferably serving as a transducer which produces signals indicating the pressure of testing fluid in the conduit 177*a* and hence the condition of wrappers W at the testing station. As shown, testing fluid is admitted into that end of the wrapper W at the testing station which is lighted by the smoker.

The manner in which furnished by the gauge 178 or another transducer are used to segregate defective cigarettes 142 (e.g., those having wrappers exhibiting pronounced holes or open seams) is well known from the art of cigarette testing.

The drum 140 of FIG. 4 does not carry ring-shaped cradles; instead, the periphery of the drum 140 is formed with pairs of axially aligned projections 182 having sockets which correspond to the sockets 38 of the cradles 39. The intake (outer) ends of the suction ports 144 terminate in the projections 182; thus, the wrappers W are held in the respective flutes 141 by static pressure because these wrappers seal the outer ends of the respective suction ports 144.

Figure 5:
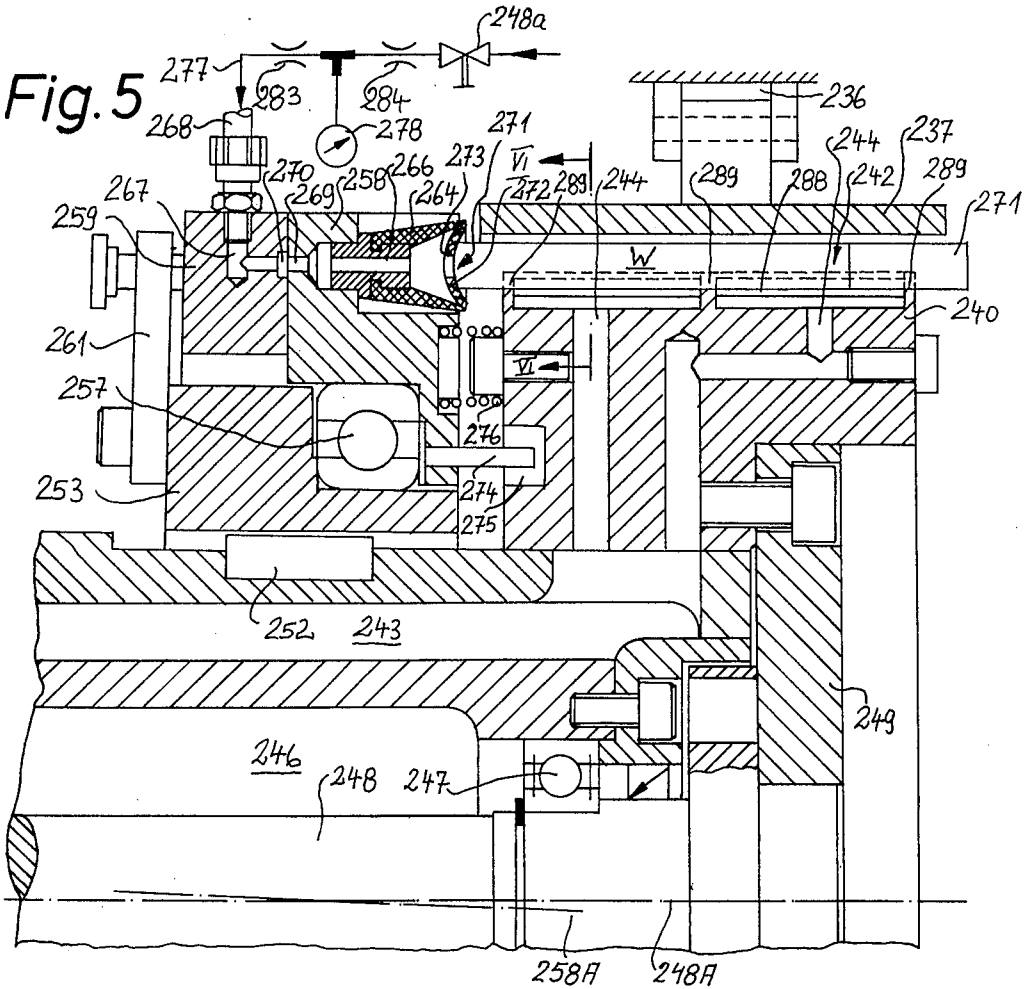
FIG. 5 is a fragmentary sectional view similar to that of FIG. 2 or 4 but showing a portion of a third testing apparatus.

FIG. 5 illustrates a portion of a third testing apparatus wherein all such parts which are identical with or clearly analogous to the corresponding parts of the first testing apparatus (FIGS. 2–3) are denoted by similar reference characters plus 200. The main difference between the apparatus of FIG. 5 and the apparatus of FIGS. 2–3 or 4 is that the left-hand ends 271 of the wrappers W of cigarettes 242 at the testing station (groove 270) receive testing fluid from the illustrated nipple 268 while the right-hand ends 271 of such wrappers remain unsealed, i.e., the right-hand end of each wrapper W can communicate with the atmosphere while the respective cigarette advances toward, past and beyond the testing station.

The supply conduit 277 which admits testing fluid into the nipple 268 and groove 270 of FIG. 5 contains two flow restrictors 283, 284 flanking a pressure gauge 278 and being located downstream of an adjustable flow regulating valve 284*a*. The source of testing fluid (e.g., compressed air) is not shown. The illustrated membrane 272 engages that end 271 of the wrapper W which is to be lighted by the smoker. If the wrapper W at the testing station is satisfactory, and if the filler of the cigarette 242 which includes such wrapper is also satisfactory, the filler offers a certain resistance to the flow of testing fluid from the aperture 273 to the right-hand end 271 of the wrapper W. The gauge 278 then produces a signal (or does not produce any signal) which is too weak to effect a segregation of the respective cigarette 242 from the preceding and next-following cigarettes. However, if the wrapper W has one or more leaks or the filler is too loose (and/or too dense), the gauge 278 produces a signal which is used to effect a segregation of the respective cigarette 242, either on the drum 240 or on one of the next-following conveyors.

The cigarettes 242 are attracted to the drum 240 by static pressure, substantially in the same way as described in connection with FIG. 4. Such static pressure must suffice to prevent the membrane 272 from shifting the cigarette 242 lengthwise (in a direction to the right, as viewed in FIG. 5) during travel of the cigarette toward, past and beyond the testing station. The periphery of the drum 240 is formed with one or more suction chambers 288 each of which communicates with at least one suction port 244. The suction chambers 288 (see also FIG. 6) are formed in part by mutually inclined protuberances 289 on the periphery of the drum 240 and in part by the wrappers W of cigarettes 242 which abut against the outer edge faces of the protuberances 289. Suction in the chambers 288 is strong enough to generate friction between the protuberances 289 and the adjacent portions of the wrappers W while the cigarettes 242 travel with the drum 240 so that the friction suffices to prevent axial shifting of cigarettes under the action of the respective membranes 272. At the same time, the suction in chambers 289 holds the cigarettes 242 against the action of centrifugal force and/or gravity so that the wrappers W need not touch the internal surface of the shroud 237. If desired, the outer edge faces of the protuberances 289 may be coated with layers of friction generating material (such as silicone rubber). In fact, each of the protuberances 289 may consist of such material or the outer edge faces of the protuberances may be roughened to enhance their retaining action against axial shifting of the wrappers.

Figure 6:
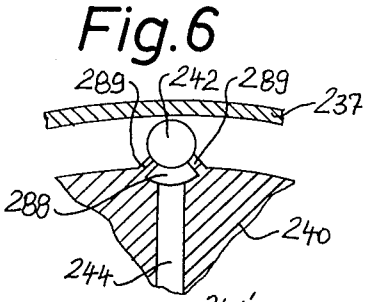
FIG. 6 is a sectional view as seen in the direction of arrows from the line VI—VI of FIG. 5.
Figure 7:
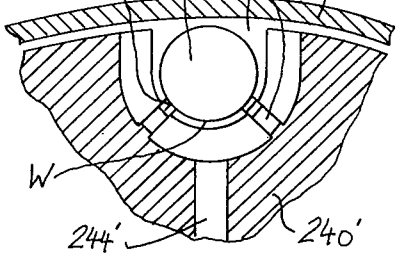
FIG. 7 is an enlarged view of a modification of the structure shown in FIG. 6.

FIG. 7 shows a modification of the structure of FIG. 6. In this embodiment (which can be used in the testing apparatus of FIG. 5), the cigarettes 242 are attracted to the respective protuberances 289' by streams of air which flow into the respective suction ports 244'. The protuberances 289' are formed with openings 291 in the form of notches and/or holes so that air can flow from the open sides of the flutes 241' into the respective ports 244'. The flutes 241' of the drum 240' are bounded by concave surfaces and are deep enough to accommodate the cigarettes 242 so that the wrappers W of such cigarettes need not touch the shroud 237'. The openings 291 act not unlike throttling orifices or flow restrictors to produce a pressure differential between the outer sides and the innermost portions of the flutes 241' whereby such pressure differential insures that the wrappers W adhere to the outer edge faces of the protuberances 289' during travel of cigarettes 242 with the drum 240'.

The testing apparatus of FIG. 5 (with the structure of FIG. 6 or 7) employs a single carrier 258.

Figure 8:
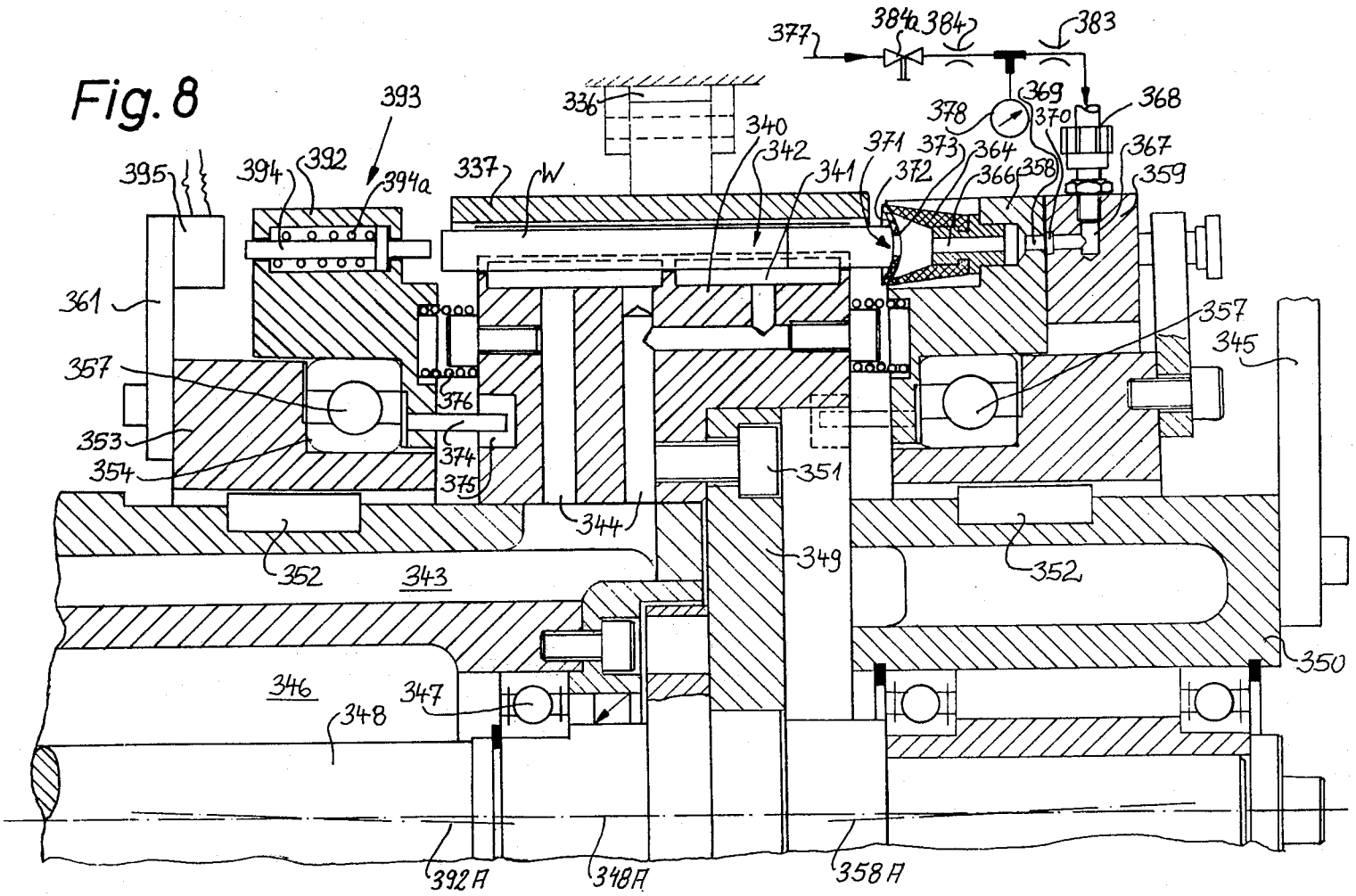
FIG. 8 is a sectional view similar to that of FIG. 2, 4 or 5 but showing a portion of a further testing apparatus.

The testing apparatus of FIG. 8 is also designed to admit testing fluid into one end of each wrapper W which reaches the testing station. All such parts of this apparatus which are identical with or clearly analogous to the corresponding parts of the apparatus of FIGS. 2–3 are denoted by similar reference characters plus 300. The admission of testing fluid takes place at the filter-tipped ends of the cigarettes 342. The apparatus comprises a carrier 358 whose axis 358A is inclined with respect to the common axis 348A of the drive shaft 348 and drum 340 and which carries an annulus of sealing elements including sleeves 364, one for each flute 341 of the drum 340. The testing fluid is admitted through an arcuate groove 370 in a segment-shaped valve plate 359 which is in sealing engagement with the right-hand side of the rotating carrier 358. The nipple 368 on the valve plate 359 is connected with a supply conduit 377 for testing fluid. This conduit contains two flow restrictors 383, 384 flanking a pressure gauge 378 and located downstream of an adjustable pressure regulating valve 384*a* which can also interrupt the admission of fluid to the nipple 368 and groove 370.

The carrier 358 is rotatable about the stationary sleeve 350 and is shown as being (but need not be) mirror symmetrical to a second annular carrier 392 which supports a means 393 for testing the ends of tobacco fillers in the wrappers W of cigarettes 342. The testing means 393 comprises a plurality of reciprocable engaging elements in the form of pins 394 each of which is in register with a flute 341 of the drum 340 and each of which is biased toward the adjacent end of a cigarette 342 by a helical spring 394*a* reacting against the carrier 392. The axis of rotation of the carrier 392 is shown at 392A. The axial positions of pins 394 at the testing station are monitored by a transducer 395 here shown as a proximity switch which can produce a signal without actually contacting the left-hand end of a pin 394. The arrangement is such that the switch 395 produces a signal when one of the springs 394*a* is free to push the corresponding pin 394 into the adjacent end of a tobacco filler, i.e., when the density of the outer end of the tobacco filler is unsatisfactory. This can take place if the particles of tobacco are free to escape from the left-hand end of a cigarette 342 during transport from the severing conveyor 26 of FIG. 1 to the testing station of FIG. 8. The pins 394 can also detect cigarettes 342 which are too short or too long.

The switch 395 is preferably angularly offset with respect to the groove 370, as considered in the circumferential direction of the drum 340. This is normally desirable in order to insure that the signals which are produced by the gauge 378 in response to detection of leaks in the wrappers W are not generated simultaneously with signals which are indicative of soft filler heads. Such angular displacement of the two testing stations can be readily achieved by appropriate inclination of the left-hand surface 354. The placing of the switch 395 out of alignement with the groove 370 is desirable on the additional ground that an attendant is more likely to rapidly detect the cause of unsatisfactory fillers and/or the cause of unsatisfactory wrappers W if the switch 395 or the gauge 378 produces a succession of signals which are indicative of defective articles. For example, the switch 395 can be placed at the 2 o'clock or 10 o'clock position, as considered from the left-hand axial end of the drum 340.

The testing of filler ends for density can be carried out in a separate apparatus which precedes or follows a testing apparatus of the type shown in FIG. 2, 4 or 5. The apparatus for testing the filler ends then resembles the apparatus of FIG. 5 butt with the carrier 392 replacing the carrier 258. Moreover, the density testing apparatus may comprise two carriers 392 with pins 394 which respectively test the ends of fillers and the ends of filter tips. If the articles to be tested are plain cigarettes, the pins 394 on the two carriers determine the density of the respective tobacco filler ends.

All embodiments of the improved apparatus share the advantage that the carrier or carriers for sealing elements (such as 64, 66, 72) and pin-shaped engaging elements 394 can move the corresponding parts gently into and from engagement with the respective ends of the rod-shaped articles which are to be tested for integrity of their fillers and/or wrappers. Moreover, the mounting of carriers for movement about axes which are inclined with respect to the axis of the drum is simpler than the mounting of a host of followers which are used in conventional testing apparatus wherein the ends of articles to be tested are engaged by tubes each of which is movable independently of the other tubes and wherein the followers track the face of a stationary cam. The carriers can insure more accurately reproducible movements of engaging elements into and from engagement with the rod-shaped articles. Also, the mounting of engaging elements on the improved carriers does not affect the versatility of the testing apparatus, i.e., the apparatus can test the articles by admitting testing fluid at both ends of each article, at one end while the other end is sealed, at one end while the other end is open to the atmosphere, by using testing fluid which is maintained above or below atmospheric pressure, by testing the wrappers simultaneously with testing of the ends of tobacco fillers (whereby the exact moment of testing of a filler head may but need not coincide with the testing of the respective wrapper), or by testing only the density of filler ends.

Without further analysis, the foregoing will so fully reveal the gist of the present invention that others can, by applying current knowledge, readily adapt it for various applications without omitting features which fairly constitute essential characteristics of the generic and specific aspects of our contribution to the art and, therefore, such adaptations should and are intended to be comprehended within the meaning and range of equivalence of the claims.

What is claimed as new and desired to be protected by Letters Patent is set forth in the appended claims:

1. Apparatus for testing cigarettes or analogous rod-shaped articles wherein an open-ended tubular wrapper surrounds a gas-permeable filler, comprising means for conveying a succession of rod-shaped articles sideways past a testing station, said conveying means being rotatable about a first axis and having a plurality of receiving means for discrete rod-shaped articles; carrier means adjacent to one end of said conveying means; means for rotating said carrier means at the speed of said conveying means; and engaging elements provided on said carrier means, one for each of said receiving means and each in register with the respective receiving means, said carrier means being rotatable about a second axis which is inclined with respect to said first axis so that successive engaging elements approach and engage the adjacent ends of articles in registering receiving means during travel of said engaging elements toward said testing station and that successive engaging elements move away from the adjacent ends of articles in registering receiving means during travel beyond said testing station.

2. Apparatus as defined in claim 1, wherein said means for rotating said carrier means comprises common drive means for said carrier means and said conveying means.

3. Apparatus as defined in claim 1, wherein said first and second axes make a small acute angle.

4. Apparatus as defined in claim 1, wherein said conveying means comprises a rotary drum and said receiving means are equidistant from each other and are provided at the periphery of said drum.

5. Apparatus as defined in claim 1, wherein said engaging elements are sealing elements each of which engages an end of the wrapper in registering receiving means during travel past said testing station, and further comprising means for passing a testing fluid through the sealing elements and the fillers of articles in respective receiving means during travel past said testing station.

6. Apparatus as defined in claim 5, wherein said means for passing testing fluid comprises passages provided in said carrier means, one for each of said sealing elements, and said sealing elements have apertures in register with the adjacent ends of wrappers in registering receiving means during travel past said testing station, the apertures of said sealing elements being in communication with the respective passages.

7. Apparatus as defined in claim 5, wherein each of said sealing elements comprises an article-engaging sealing portion which is movable with respect to said carrier means.

8. Apparatus as defined in claim 7, wherein said portions of said sealing elements are elastic membranes.

9. Apparatus as defined in claim 5, further comprising a valve plate provided at said testing station, said carrier means being rotatable between said valve plate and said one end of said conveying means and said valve plate having a groove adjacent to said carrier means, said means for passing testing fluid comprising conduit means communicating with said groove and passages in said carrier means, one for each of said sealing elements, said passages communicating with said groove during travel past said testing station and said sealing elements having apertures in register with the adjacent ends of wrappers in registering receiving means during travel past said testing station, the apertures of said sealing elements being in communication with the respective passages of said carrier means.

10. Apparatus as defined in claim 5, wherein each of said sealing elements comprises a nozzle secured to said carrier means and an apertured article-engaging portion mounted on said nozzle.

11. Apparatus as defined in claim 10, wherein said means for passing testing fluid comprises passages provided in said carrier means and communicating with said nozzles.

12. Apparatus as defined in claim 10, wherein said article-engaging portions of said sealing elements consist at least in part of a highly elastic material.

13. Apparatus as defined in claim 1, wherein said carrier means is movable along said second axis toward and away from said one end of said conveying means, and further comprising guide means for said carrier means and means for releasably maintaining said carrier means at a selected distance from said one end of said conveying means.

14. Apparatus as defined in claim 1, further comprising second carrier means adjacent to the other end of said conveying means, means for rotating said second carrier means at the speed of said conveying means, and second engaging elements provided on said second carrier means, one for each of said receiving means and each in register with the respective receiving means, said second carrier means being rotatable about a third axis which is inclined with respect to said first axis so that successive second engaging elements approach and engage the adjacent ends of articles in registering receiving means during travel of said second engaging elements toward said testing station and that successive second engaging elements move away from engagement with the adjacent ends of articles in registering receiving means during travel beyond said testing station.

15. Apparatus as defined in claim 14, wherein said second carrier means is mirror symmetrical to said first mentioned carrier means with respect to a plane which is located between said carrier means and is normal to said first axis.

16. Apparatus as defined in claim 14, wherein each of said engaging elements comprises a portion which sealingly engages the adjacent end of the wrapper in registering receiving means during travel past said testing station, and further comprising means for passing a testing fluid through the engaging elements and the fillers of articles in registering receiving means during travel past said testing station.

17. Apparatus as defined in claim 14, wherein said second engaging elements comprise portions which bear against the fillers of articles in registering receiving means during travel past said testing station so that a second element can penetrate into a relatively soft filler at said testing station, and further comprising means for producing signals in response to penetration of said second engaging elements into the adjacent fillers.

18. Apparatus as defined in claim 1, further comprising a second testing station angularly offset with respect to said first mentioned testing station, as considered in the direction of travel of said receiving means, second carrier means adjacent to the other end of said conveying means, means for rotating said second carrier means at the speed of said conveying means, and second engaging elements provided on said second carrier means, one for each of said receiving means and each in register with the respective receiving means, said second carrier means being rotatable about a third axis which is inclined with respect to said first axis so that successive second engaging elements approach and engage the adjacent ends of fillers in registering receiving means during travel of said second engaging elements toward said second testing station and that successive second engaging elements are disengaged from the adjacent fillers during travel beyond said second testing station.

19. Apparatus as defined in claim 18, further comprising means for biasing said second engaging elements against the fillers in registering receiving means at said second testing station so that a second engaging element penetrates into a relatively soft filler, and means for producing signals in response to penetration of said second engaging elements into soft fillers.

20. Apparatus as defined in claim 1, wherein said engaging elements comprise portions which bear against the fillers of articles in registering receiving means during travel past said testing station so that an engaging element can penetrate into a relatively soft filler at said testing station, and further comprising means for producing signals in response to penetration of said engaging elements into soft fillers.

21. Apparatus as defined in claim 20, further comprising means for yieldably biasing said engaging elements against the fillers in registering receiving means at said testing station.

* * * * *